US007322427B2

(12) United States Patent
Shimma et al.

(10) Patent No.: US 7,322,427 B2
(45) Date of Patent: Jan. 29, 2008

(54) POWER IMPACT TOOL

(75) Inventors: Yasutoshi Shimma, Anjo (JP); Yoshihiro Kasuya, Anjo (JP); Masanori Furusawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 38 days.

(21) Appl. No.: 11/147,384

(22) Filed: Jun. 8, 2005

(65) Prior Publication Data

US 2006/0011361 A1 Jan. 19, 2006

(30) Foreign Application Priority Data

Jun. 16, 2004 (JP) ..... 2004-178964

(51) Int. Cl.
*H01H 9/20* (2006.01)

(52) U.S. Cl. ..... 173/48; 173/217; 173/170; 200/50.32; 200/332.1; 200/334

(58) Field of Classification Search ..... 173/47, 173/217, 170, 48; 200/335, 536, 564, 565, 200/567, 293.1, 332, 43.17, 42.01, 336, 522, 200/523, 513, 50.32, 332.1, 334, 5 B; 310/50
See application file for complete search history.

(56) References Cited

U.S. PATENT DOCUMENTS 4,381,037 A 4/1983 Cuneo
4,428,438 A * 1/1984 Holzer ..... 173/48
4,763,733 A * 8/1988 Neumaier ..... 173/48
4,776,406 A 10/1988 Wanner
5,842,527 A * 12/1998 Arakawa et al. ..... 173/48
6,109,364 A * 8/2000 Demuth et al. ..... 173/48
6,176,321 B1 * 1/2001 Arakawa et al. ..... 173/48
6,489,578 B1 * 12/2002 Jung et al. ..... 200/332.2
6,520,267 B2 * 2/2003 Funfer et al. ..... 173/48
6,548,776 B1 * 4/2003 Jong ..... 200/334
6,550,545 B1 4/2003 Manschitz et al.
6,555,773 B1 * 4/2003 Broghammer et al. ... 200/61.85
6,610,938 B2 * 8/2003 Funfer ..... 200/11 R
6,725,944 B2 * 4/2004 Burger et al. ..... 173/48
6,868,919 B1 * 3/2005 Manschitz et al. ..... 173/47

(Continued)

FOREIGN PATENT DOCUMENTS

FR 2 625 931 A 7/1989

(Continued)

*Primary Examiner*—Rinaldi I. Rada
*Assistant Examiner*—Michelle Lopez
(74) *Attorney, Agent, or Firm*—Oliff & Berridge, PLC

(57) ABSTRACT

It is an object of the present invention to provide an effective technique to improve ease of operation of the power impact tool. The power tool of the present invention includes a tool body, a tool bit, a motor, first and second switches and a mode changing mechanism. The motor is driven only when both switches are in an on position. The first switch is biased in the off position. The second switch is biased in the last position operated. The mode changing mechanism switches between hammer operation modes such that in the first hammer mode, the user actuates the first switch while the second switch is locked in the on position and in the second hammer mode, the first switch is locked in the on position while the second switch is actuated. In the second hammer mode, actuating the second switch similar to a toggle switch operates the tool.

15 Claims, 9 Drawing Sheets

U.S. PATENT DOCUMENTS

| | | | | |
|---|---|---|---|---|
| 7,073,605 | B2 * | 7/2006 | Saito et al. | 173/48 |
| 2003/0037937 | A1 | 2/2003 | Frauhammer et al. | |

FOREIGN PATENT DOCUMENTS

| | | | |
|---|---|---|---|
| GB | 24796 | A | 10/1913 |
| GB | 2 314 288 | B | 12/1997 |
| JP | A 2001-062756 | | 3/2001 |
| RU | 2 076 801 | C1 | 4/1997 |
| SU | 41467 | A1 | 1/1935 |
| SU | 614937 | A1 | 7/1978 |
| WO | WO 90/01786 | | 2/1990 |

* cited by examiner

POWER IMPACT TOOL

BACKGROUND OF THE INVENTION

1. Field of the Invention

The present invention relates to a power impact tool capable of performing a hammering operation on a workpiece by the striking movement of a tool bit, and more particularly, to a technique of switching between operation modes of the tool bit.

2. Description of the Related Art

Japanese non-examined laid-open Patent Publication No. 2001-62756 discloses a power impact tool capable of performing a hammering operation on a workpiece. The known power impact tool includes a tool bit, a motor for driving the tool bit, an on-off power switch for the motor, a trigger for operating the power switch, and a mode-changing member for switching between respective operation modes of the tool bit. Specifically, the mode-changing member can switch between a hammer mode in which the hammer bit is caused to perform a striking movement and a hammer drill mode in which the hammer bit is caused to perform a combined movement of striking and rotating. The power impact tool further includes an engaging member that can releasably lock the trigger in a depressed position. In order to drive the hammer bit with the mode-changing member in the hammer mode, the trigger is depressed to turn on the power switch and then locked in the depressed position by the engaging member. Thus, in the hammer mode, the tool bit can be caused to perform continuous striking movement without needs of operating the trigger when the trigger is locked in the depressed position by the engaging member. When the lock of the trigger by the engaging member is released, the trigger is allowed to be operated to turn the power switch on and off, so that the tool bit can be caused to perform intermittent striking movement.

However, according to the known power impact tool, in order to effect continuous hammering operation by the tool bit, the user must depress the trigger and then operate the engaging member to lock the trigger in the depressed position every time when trying to drive the hammer bit.

SUMMARY OF THE INVENTION

Accordingly, it is an object of the present invention to provide an effective technique to improve ease of operation of the power impact tool.

The representative power impact tool according to the present invention includes a tool body, a tool bit, a motor, first and second switches and a mode changing mechanism. The tool bit performs a striking movement. The motor drives the tool bit. The motor is driven only when both of the switches are turned on. The first switch is urged from the on position side to the off position side and normally held in the off position. Typically and preferably, the first switch may be defined by a trigger provided on a hand-grip of the power impact tool. On the other hand, the second switch is turned between the on position and the off position and held in one of the on and off positions unless operated to be turned to the opposite position. Typically and preferably, the second switch may be defined by a toggle switch. The mode changing mechanism switches between hammer operation modes of the tool bit. According to the first hammer mode, the user is allowed to actuate the first switch while the second switch is locked in the on position. Further, according to the second hammer mode, the first switch is locked in the on position while the user is allowed to actuate the second switch.

According to the invention, when the power impact tool is operated in the second hammer mode, the first switch such like a trigger is locked in the on-position while the user is allowed to actuate the second switch such like a toggle switch to drive the motor. Therefore, while the first switch is normally urged and held in the off position, the user is not required to keep the first switch in the on-position by hand in the second hammer mode. As a result, ease of operation of the power impact tool is enhanced compared with the known art. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power impact tools and method for using such power impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
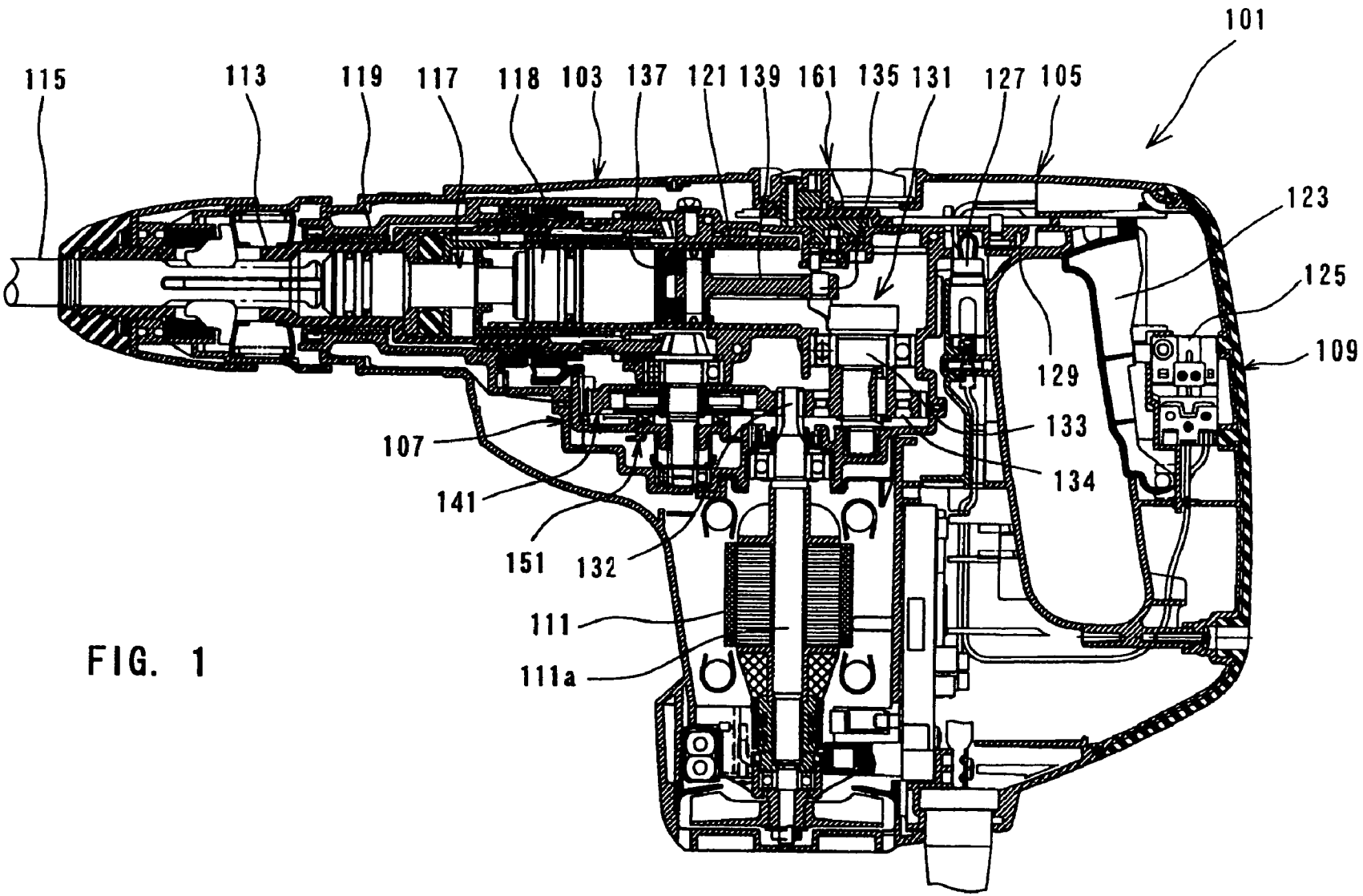
FIG. 1 is a sectional view schematically showing an entire electric hammer drill according to an embodiment of the invention.
Figure 2:
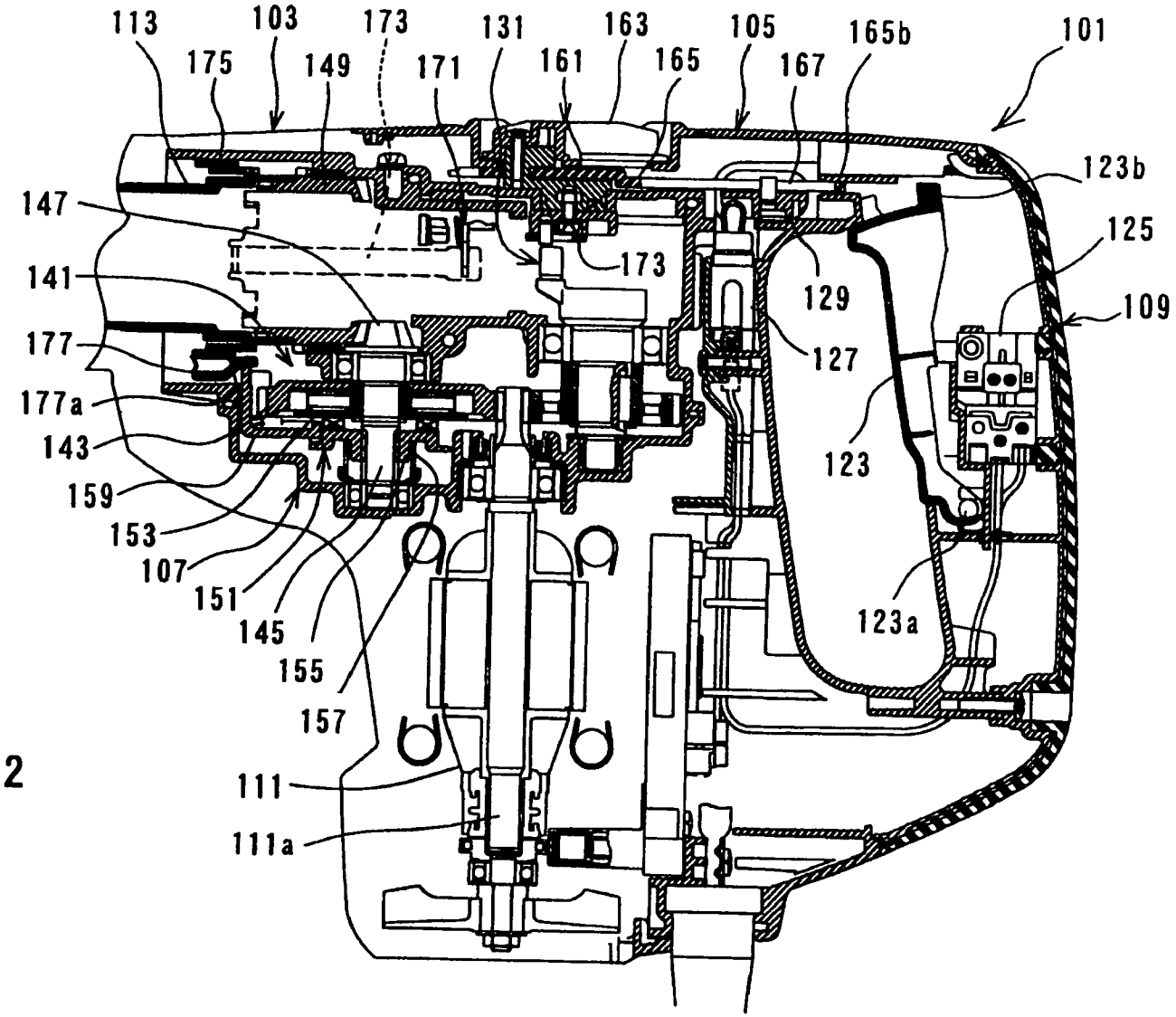
FIG. 2 is a sectional view of an essential part of the representative electric hammer drill, including a clutch operating mechanism, with clutches in engagement with each other.
Figure 3:
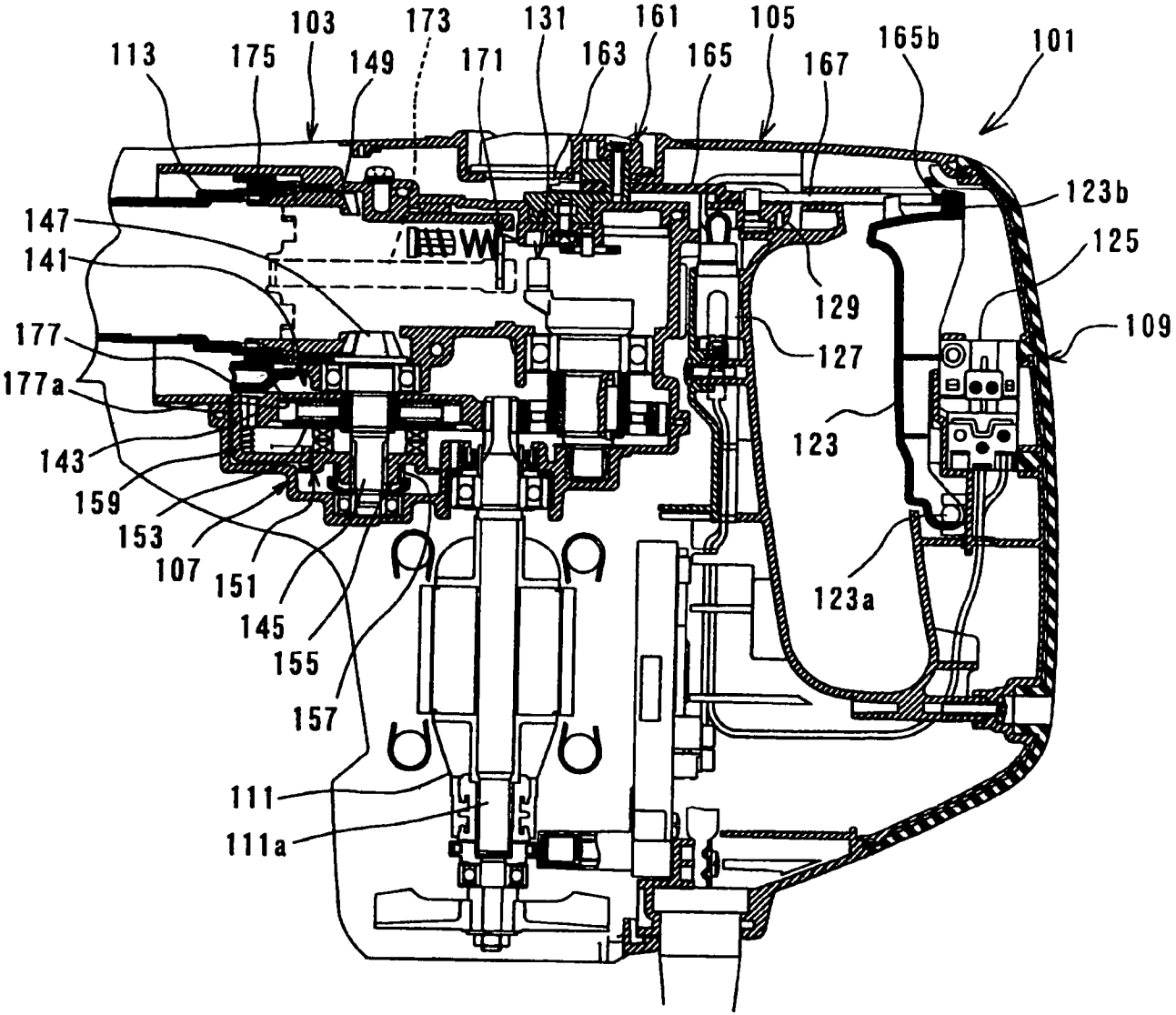
FIG. 3 is a sectional view of an essential part of the representative electric hammer drill including a clutch operating mechanism, with clutches in disengagement from each other.
Figure 4:
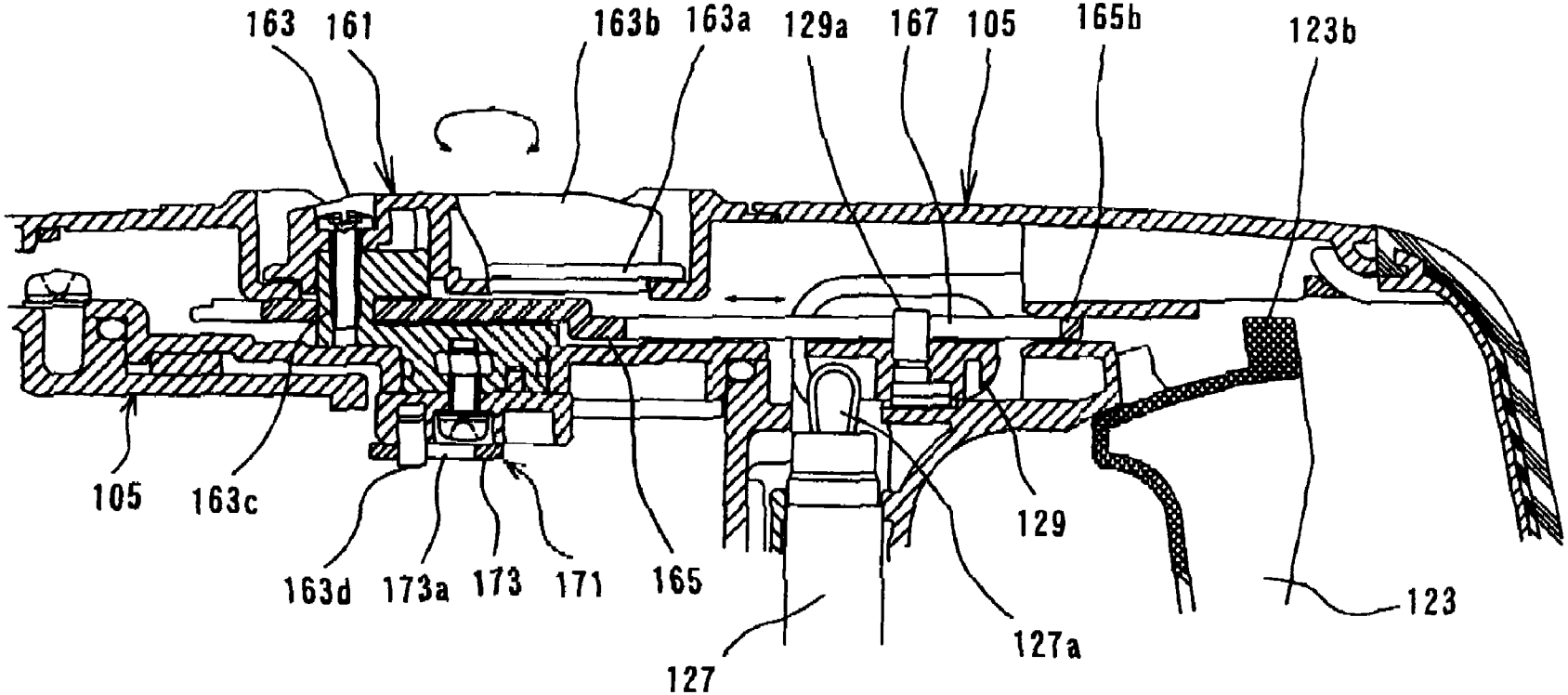
FIG. 4 is an enlarged sectional view showing a mode-changing mechanism.
Figure 5:
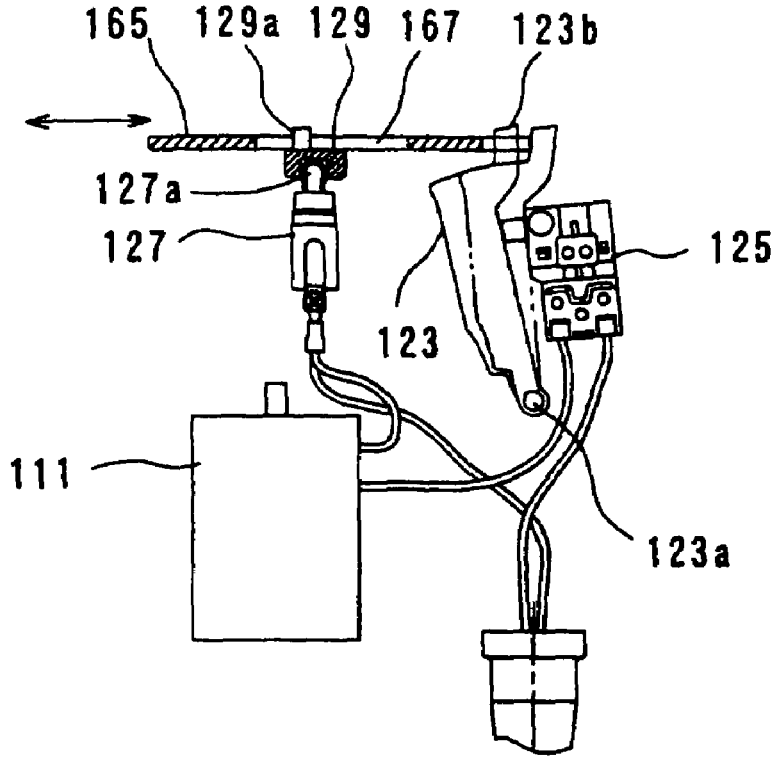
FIG. 5 shows the wiring of a driving motor.
Figure 6:
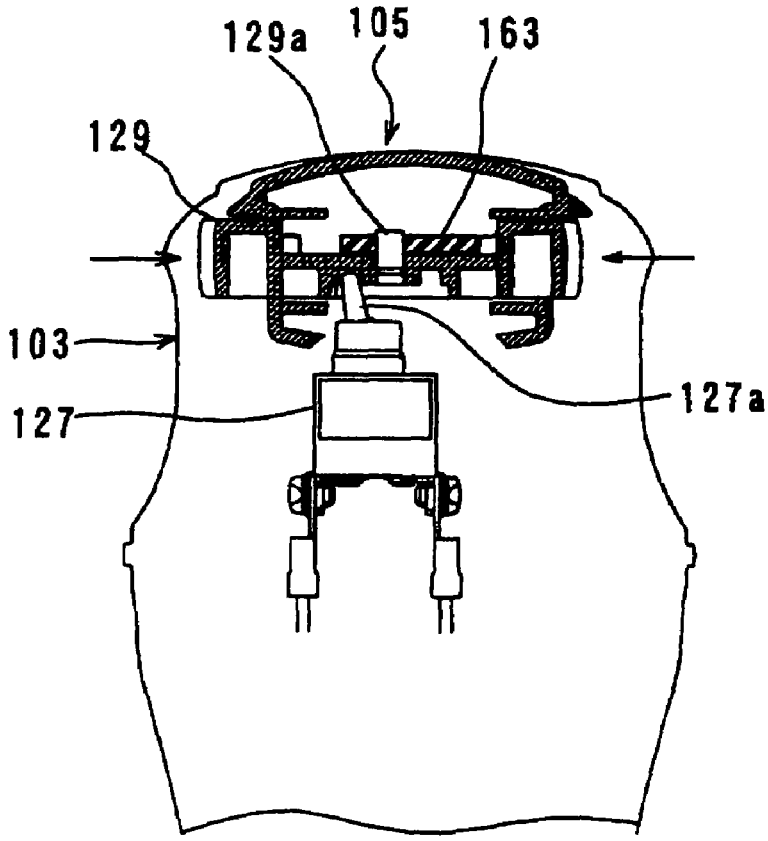
FIG. 6 is a sectional view showing a sub-switch and a switch actuating member.
Figure 11:
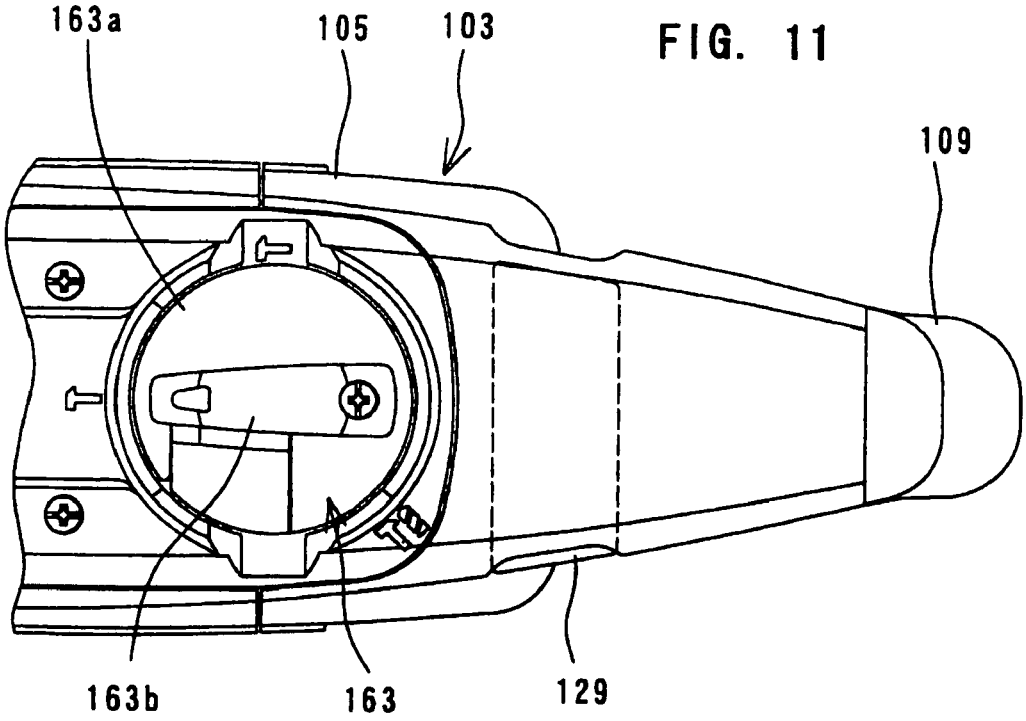
FIG. 11 is a plan view showing the mode-changing mechanism in the second hammer mode position.
Figure 12:
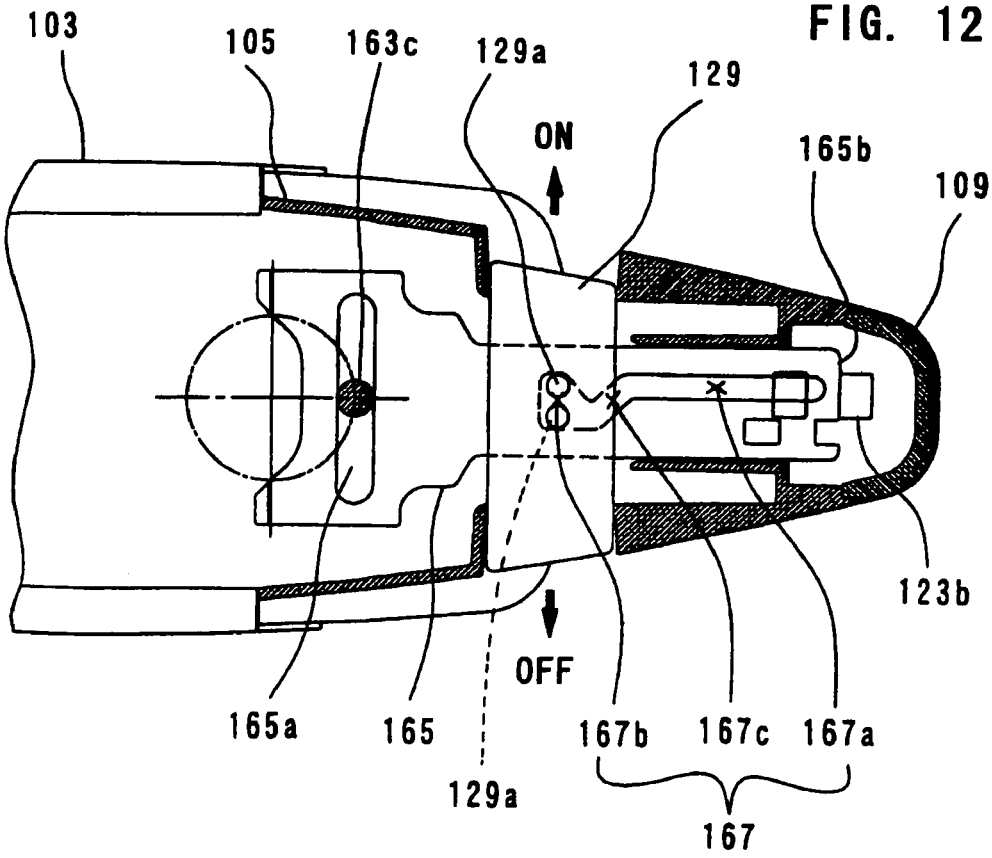
FIG. 12 is a sectional plan view showing the switch actuating member, the trigger and the switch actuating member with the mode-changing mechanism in the second hammer mode position.
Figure 13:
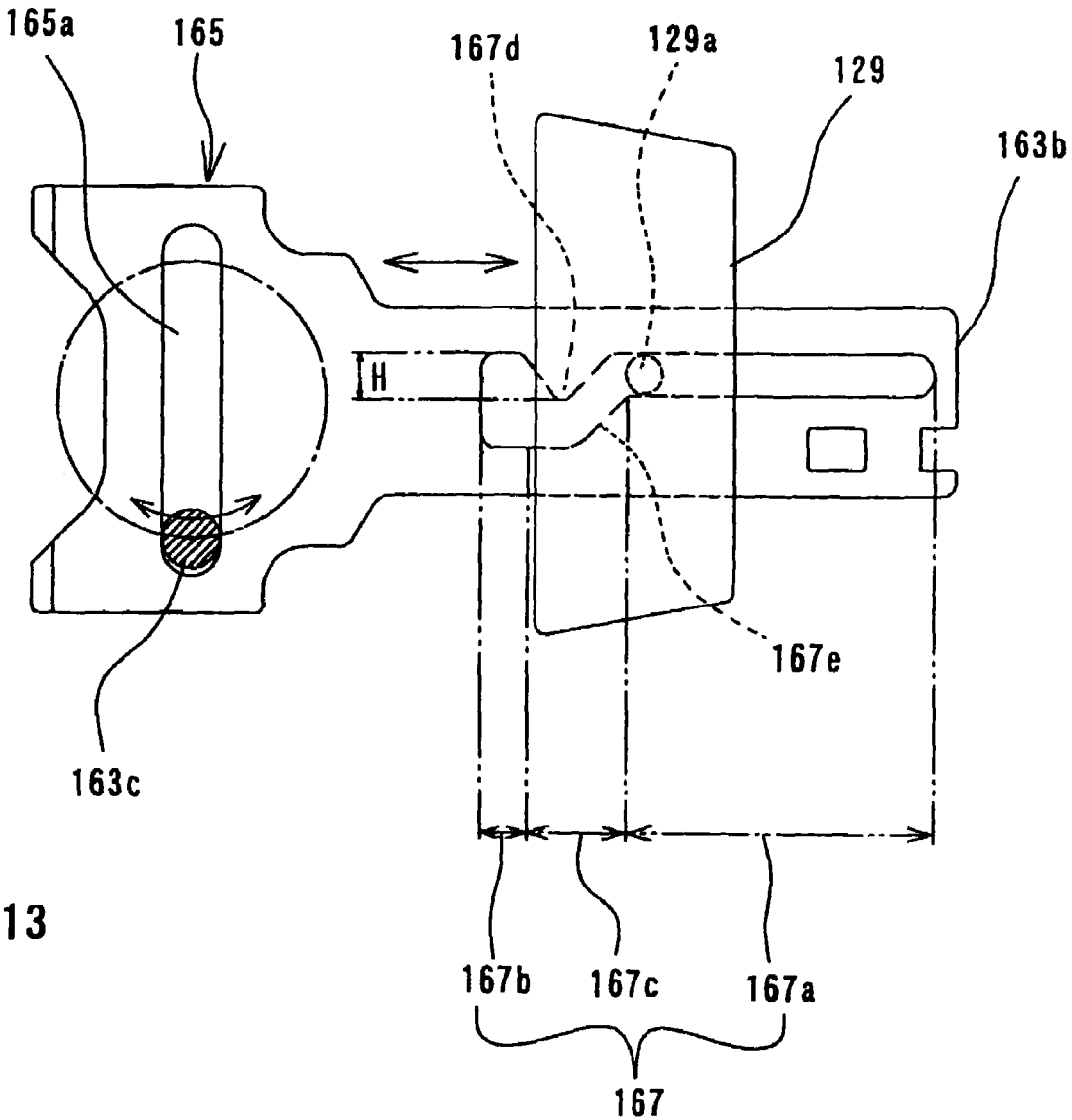
FIG. 13 is an enlarged view showing a sub-switch actuating cam groove of a switch actuating member.

A representative embodiment of the present invention will now be described with reference to FIGS. 1 to 13. FIG. 1 shows an entire electric hammer drill 101 as a representative embodiment of the power impact tool according to the present invention. FIGS. 2 and 3 show the essential part of the hammer drill 101. FIG. 4 shows a mode changing mechanism 161 in an enlarged view. FIG. 5 shows the wiring of a driving motor 111. FIG. 6 shows a sub-switch 127 and a switch actuating member 129. FIGS. 7 to 12 show the mode changing mechanism 161 and the manner of switching between respective modes. FIG. 13 shows a sub-switch actuating cam groove 167 of a switch actuating member 165, in enlarged view. As shown in FIG. 1, the hammer drill 101 of this embodiment includes a body 103, a tool holder 113 connected to the tip end region of the body 103, and a hammer bit 115 detachably coupled to the tool holder 113. The hammer bit 115 is held in the tool holder 113 such that it is allowed to slide with respect to the tool holder 113 in its longitudinal direction and prevented from rotating with respect to the tool holder 113 in its circumferential direction. The hammer bit 115 is a feature that corresponds to the "tool bit" according to the present invention.

The body 103 includes a motor housing 105 that houses a driving motor 111, a gear housing 107 that houses a motion converting mechanism 131 and a striking mechanism 115, and a handgrip 109. The driving motor 111 is mounted such that a rotating shaft 111*a* of the driving motor runs generally perpendicularly to the longitudinal direction of the body 103 (vertically as viewed in FIG. 1). The motion converting mechanism 131 is adapted to convert the rotating output of the driving motor 111 to linear motion and then to transmit it to the striking mechanism 117. As a result, an impact force is generated in the axial direction of the hammer bit 115 via the striking mechanism 117. The motion converting mechanism 131 includes a crank mechanism driven by the driving motor 111 via a plurality of gears 132, 134. The crank mechanism includes a crank shaft 133, a crank pin 135 mounted on the crank shaft 133, a piston 137, and a connecting rod 139 that connects the piston 137 and the crank pin 135. The piston 137 is adapted to drive the striking mechanism 117 and can slide within a cylinder 121 in the axial direction of the hammer bit 115. The motor 111 and the cylinder 121 are arranged such that their axes run generally perpendicularly to each other.

The striking mechanism 117 includes a striker 118 and an impact bolt 119. The striker 118 is slidably disposed within the bore of the cylinder 121 together with the piston 137. The impact bolt 119 is slidably disposed within the tool holder 113 and is adapted to transmit the kinetic energy of the striker 118 to the hammer bit 115.

The tool holder 113 is rotated by the driving motor 111 via a power transmitting mechanism 141 having a gear train. A clutch mechanism 151 is disposed in the power transmitting mechanism 141 and is adapted to enable or disable the power transmitting mechanism 141 to transmit rotation of the motor 111 to the tool holder 113 via the clutch mechanism 151.

As shown in FIGS. 2 and 3, the power transmitting mechanism 141 includes an intermediate gear 143 driven by the motor 111, an intermediate shaft 145, a first bevel gear 147 and a second bevel gear 149. Rotation of the intermediate gear 143 is transmitted to the intermediate shaft 145 via the clutch mechanism 151. Rotation of the intermediate shaft 145 is in turn transmitted to the tool holder 113 via the first bevel gear 147 and the second bevel gear 149. The intermediate shaft 145 is arranged parallel to the rotating shaft 111*a* of the motor 111 and perpendicularly to the axial direction of the hammer bit 115. The clutch mechanism 151 includes engaging claw clutches, i.e. a driving clutch 153 and a driven clutch 155. The driving clutch 153 is loosely fitted on the intermediate shaft 145. The driven clutch 155 is fitted on the intermediate shaft 145 by spline engagement such that the driven clutch 155 can slide with respect to the intermediate shaft 145 in its axial direction and rotate together with the intermediate shaft 145 in its circumferential direction. The driven clutch 155 is urged toward the driving clutch 153 by the biasing force of a biasing member in the form of a clutch spring 157. The driven clutch 155 transmits the rotation to the intermediate shaft 145 when the driven clutch 155 is in engagement with the driving clutch 153. When the driven clutch 155 is disengaged from the driving clutch 153 against the biasing force of the clutch spring 157, the driven clutch 155 is prevented from transmitting the rotation. Switching control of the clutch mechanism 151 will be explained below.

FIG. 5 shows the wiring of a driving motor 111. As shown in FIG. 5, the motor 111 is started when both a main switch 125 and a sub-switch 127 are turned to their respective ON positions, while the motor 111 is stopped when either one or both of the main switch 121 and the sub-switch 127 are turned to the OFF positions. The main switch 125 is an automatic-reset type switch that is turned to the ON position by depressing a trigger 123 and returned to the OFF position by the biasing force of a spring (not shown) by releasing the trigger 123. The main switch 125 is disposed within the handgrip 109. The sub-switch 127 is a toggle switch that is toggled between the ON and OFF positions by means of a switch actuating member 129 and held in that position until it is toggled to the opposite position. The main switch 125 and the trigger 123 correspond to the "first switch" in this invention. The sub-switch 127 and the switch actuating member 129 correspond to the "second switch" in this invention.

The trigger 123 is mounted on the handgrip 109 such that it can rotate about a pivot 123*a*. When the user depresses the trigger 123, the trigger 123 is turned to a position that places the main switch 125 in the ON position. When the user releases the trigger 123, the trigger 123 is returned to its initial position as the main switch 125 returns to the OFF position.

As shown in FIG. 6, the switch actuating member 129 extends through the motor housing 105 such that either of its ends protrudes through the side surface of the motor housing 105 when the user pushes the switch actuating member 129 laterally to slide. Specifically, the switch actuating member 129 is mounted such that it can slide in a direction of extending through the side surfaces of the motor housing 105, i.e. in a direction perpendicular to the longitudinal direction of the body 103. Further, the switch actuating member 129 is engaged with a knob 127*a* of the sub-switch 127. Thus, the sub-switch 127 is toggled to the ON position when the user pushes in the switch actuating member 129 from one or the other side surface of the motor housing 105, while the sub-switch 127 is toggled to the OFF position when the user pushes in the switch actuating member 129 in the opposite direction.

The hammer drill 101 includes a mode changing mechanism 161. The mode changing mechanism 161 can change between a hammer-drill mode, a first hammer mode and a second hammer mode. In the hammer-drill mode, the hammer bit 115 is caused to perform a combined movement of striking and rotation. In the first hammer mode, the hammer bit 115 is caused to perform a striking movement by the operation of the trigger 123. In the second hammer mode, the hammer bit 115 is caused to perform a striking movement by the actuation of the switch actuating member 129.

Figure 7:
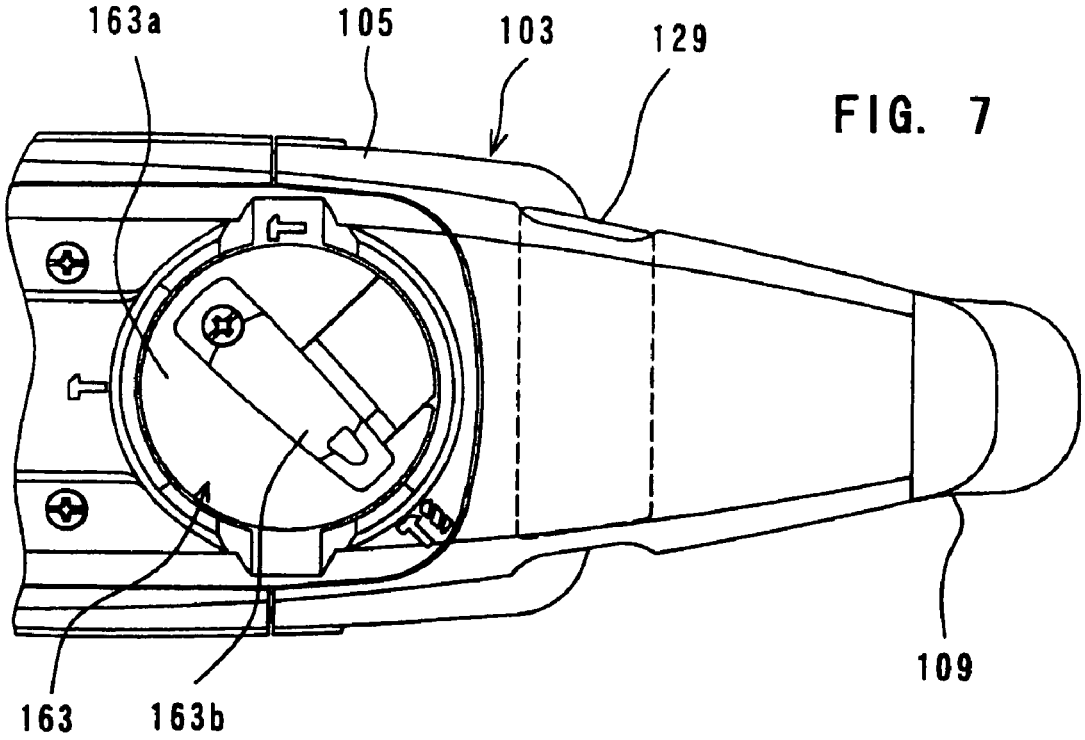
FIG. 7 is a plan view showing a mode-changing mechanism in the hammer drill mode position.
Figure 8:
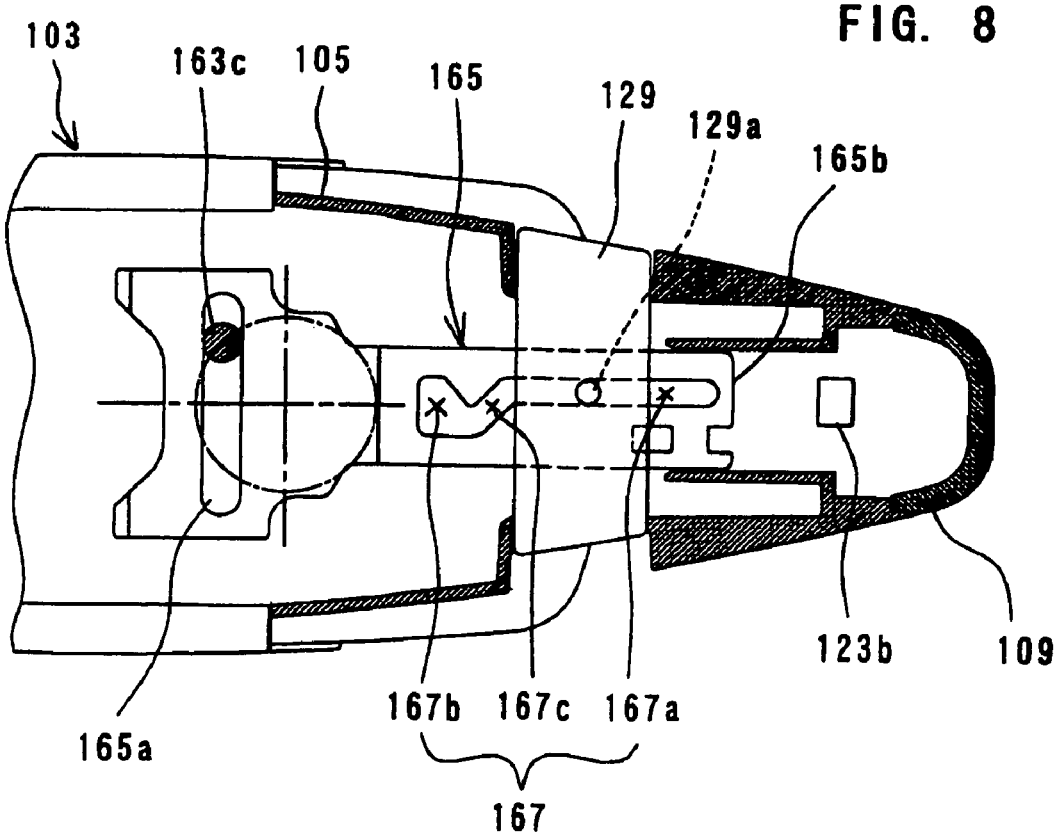
FIG. 8 is a sectional plan view showing a switch actuating member, a trigger and a switch actuating member with the mode-changing mechanism in the hammer drill mode position.
Figure 9:
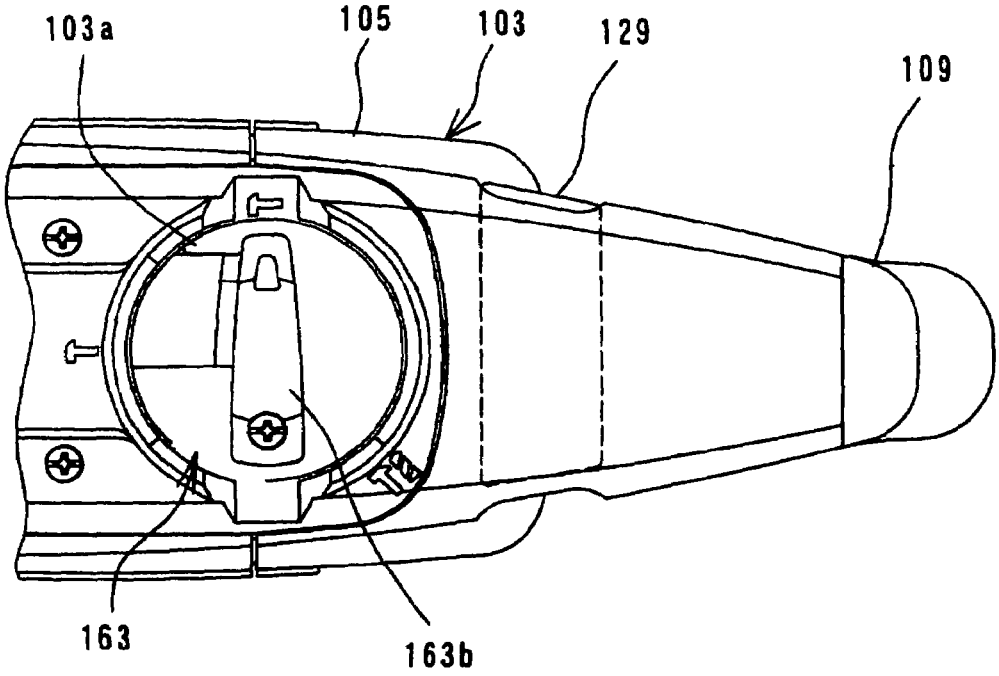
FIG. 9 is a plan view showing the mode-changing mechanism in the first hammer mode position.
Figure 10:
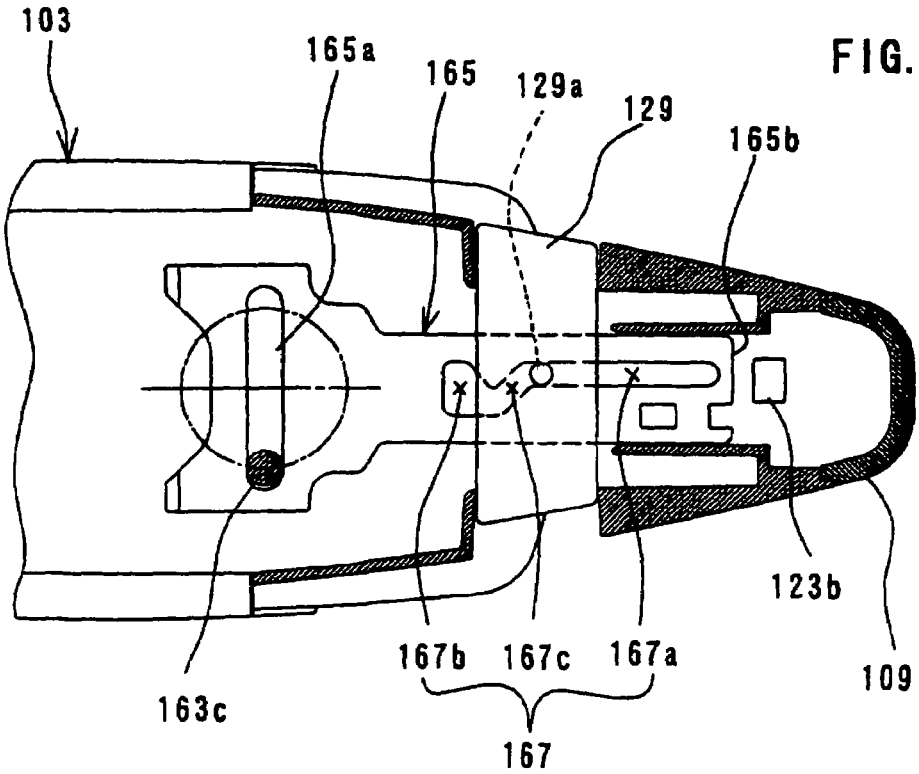
FIG. 10 is a sectional plan view showing the switch actuating member, the trigger and the switch actuating member with the mode-changing mechanism in the first hammer mode position.

FIGS. 7 and 8 show the mode changing mechanism 161 in the hammer-drill mode; FIGS. 9 and 10 show it in the first hammer mode; and FIGS. 11 and 12 show it in the second hammer mode. Further, FIG. 2 shows the state in the hammer-drill mode in which the clutch mechanism 151 is engaged and the hammer bit 115 performs a combined movement of striking and rotation. FIG. 3 shows the state in the first and second hammer modes in which the clutch mechanism 151 is disengaged and the hammer bit 115 performs a striking movement.

As shown in FIGS. 2 to 4, the mode changing mechanism 161 includes a mode-changing operating member 163, a switch actuating member 165 and a clutch operating mechanism 171. The movement of the switch actuating member 165 is interlocked with the operation of the mode-changing operating member 163 so as to lock the trigger 123 and the switch actuating member 129 in their respective ON positions or to allow them to be operated between the ON position and the OFF position. The clutch operating mechanism 171 controls engagement of the clutch mechanism 151 according to the switching operation of the mode-changing operating member 163. The mode-changing operating member 163 is mounted externally on the upper surface of the motor housing 105 such that it can be operated by the user. Specifically, the mode-changing operating member 163 is disposed on the side opposite to the clutch mechanism 151 with respect to the cylinder 121. The mode-changing operating member 163 includes a disc 163*a* with an operating grip 163*b* and is mounted on the motor housing 105 such that it can be turned in a horizontal plane. As shown in FIG. 7, the operating grip 163*b* is mounted on the upper surface of the disc 163*a* and extends in the diametrical direction of the disc. One end of the operating grip 163*b* in the diametrical direction is tapered and forms a switching position pointer. The three mode positions, i.e. hammer drill mode position, first hammer mode position and second hammer mode position, are marked on the motor housing 105 in predetermined intervals in the circumferential direction of the disc 163*a*. Further, a first eccentric pin 163*c* and a second eccentric pin 163*d* are mounted on the underside of the disc 163*a* of the mode-changing operating member 163 in the respective positions displaced from the center of rotation of the disc 163*a*. The first eccentric pin 163*c* and the second eccentric pin 163*d* actuate the switch actuating member 165 and the clutch operating mechanism 171, respectively.

The switch actuating member 165 is defined by a plate member and has a slot 165*a* in one end portion. The first eccentric pin 163*c* is engaged in the slot 165*a*. Thus, the switch actuating member 165 is caused to move lineally in the longitudinal direction of the body 103 (or the tool bit 115) via the first eccentric pin 163*c* when the mode-changing operating member 163 is operated (turned) to switch between the hammer drill mode, the first hammer mode and the second hammer mode. In other words, the switch actuating member 165 moves in a direction generally perpendicular to the moving direction of the switch actuating member 129 and in the direction of depressing the trigger 123. The trigger 123 and the switch actuating member 129 are arranged substantially side by side in the moving direction of the switch actuating member 165. The switch actuating member 165 is disposed within the motor housing 105 and extends generally horizontally toward the trigger 123 over the switch actuating member 129. The switch actuating member 165 has a cam groove 167 extending in its moving direction. The switch actuating member 129 has a lug 129*a* and the lug 129*a* is engaged with the cam groove 167. Further, the switch actuating member 165 extends into the handgrip 109 across the connection between the handgrip 109 and the body 103. An end 165*b* of the switch actuating member 165 in the handgrip 109 faces an end 123*b* of the trigger 123 (which is remote from the pivot 123*a*) and can abut on it.

The end 165*b* of the switch actuating member 165 moves away from the end 123*b* of the trigger 123 when the mode-changing operating member 163 is turned to the hammer drill mode position or the first hammer mode position. In this state, the on-off operation of the main switch 125 by the trigger 123, or the depressing and releasing of the trigger 123 is allowed. When the mode-changing operating member 163 is turned to the second hammer mode position, the end 165*b* of the switch actuating member 165 moves toward the trigger 123 and presses on the end 123*b* of the trigger 123. As a result, the trigger 123 is moved to a depressed position, or a position that places the main switch 125 in the ON position, and locked in the depressed position.

As shown in FIG. 13 in enlarged view, the cam groove 167 of the switch actuating member 165 has a locking region 167*a* and a switch actuation allowing region 167*b* in the moving direction of the switch actuating member 165. In the locking region 167*a*, the switch actuating member 129 of the sub-switch 127 is locked in the ON position. In the switch actuation allowing region 167*b*, the user is allowed to actuate the switch actuating member 129 between the ON position and the OFF position. The cam groove 167 in the locking region 167*a* has such a width as to prevent the lug 129*a* of the switch actuating member 129 from moving in the switching direction of the switch actuating member 129. Thus, the user is prevented from turning the sub-switch 127 on and off via the switch actuating member 129. The cam groove 167 in the switch actuation allowing region 167*b* has such a large width in the direction generally perpendicular to the moving direction of the switch actuating member 165 or in the switching direction so as to allow the sub-switch 120 to be switched between the ON and OFF positions. The lug 129*a* of the switch actuating member 129 is located in the locking region 167*a* when the mode-changing operating member 163 is in the hammer drill mode position or the first hammer mode position (see FIGS. 8 and 10). The lug 129*a* of the switch actuating member 129 is located in the switch actuation allowing region 167*b* when the mode-changing operating member 163 is in the second hammer mode position (see FIG. 12).

The cam groove 167 further has a switching region 167*c* between the locking region 167*a* and the switch actuation allowing region 167*b*. In the switching region 167*c*, the switch actuating member 129 is forced to be switched between the ON position and the OFF position according to the movement of the switch actuating member 165. The cam groove 167 in the switching region 167*c* is inclined a predetermined angle with respect to the moving direction of the switch actuating member 165. The cam groove 167 in the switching region 167*c* has a V-shaped guide wall 167*d* that guides the lug 129*a* of the switch actuating member 129 from the ON position to the OFF position according to the movement of the switch actuating member 165 and a guide wall 167*e* that guides the lug 129*a* of the switch actuating member 129 from the OFF position to the ON position. The V-shaped guide wall 167*d* has a height H (see FIG. 13) required to turn the sub-switch 127 from the ON position to the OFF position. Specifically, the height H corresponds to the switch stroke.

As shown in FIGS. 2 and 3, the clutch operating mechanism 171 includes a frame member 173 that is generally U-shaped in plan view, a ring 175 and a wedge-shaped cam 177. The frame member 173 is caused to move lineally in the longitudinal direction of the cylinder 121 (the axial direction of the hammer bit 115) by revolving movement of the second eccentric pin 163*d* of the mode-changing operating member 163. The ring 175 is coupled to the frame member 173. The cam 177 is mounted on the ring 175 and adapted to control the engagement of the clutch mechanism 151. The frame member 173 is disposed generally horizontally within the gear housing 107. The frame member 173 is generally U-shaped having a base which is engaged with the mode-changing operating member 163 and two legs which extend toward the ring member 175. Specifically, a slot 173*a* (shown in FIGS. 2 and 3 in sectional view) is formed in the base of the frame member 173 and engages with the second eccentric pin 163*d*. Thus, the frame member 173 can be moved in the longitudinal direction of the cylinder 121 by revolving movement of the second eccentric pin 163*d*. The legs of the frame member 173 extend in the longitudinal direction of the cylinder 121 (as shown by dotted line in FIGS. 2 and 3) and are coupled to the ring 175 at their ends.

As shown in FIGS. 2 and 3, the ring 175 is disposed around the outside of the cylinder 121 and can slide with respect to the gear housing 107 in the longitudinal direction of the body 103. The cam 177 is secured to the ring 175 and moves together with the ring 175. The cam 177 lies apart from a clutch control member 159 of the clutch mechanism 151 when the mode-changing operating member 163 is in the hammer drill mode position (see FIG. 2). In this state, the driven clutch 155 is in engagement with the driving clutch 153. When the mode-changing operating member 163 is turned to the first hammer mode position or the second hammer mode position, a slanted surface 177*a* of the cam 177 presses on the clutch control member 159 (see FIG. 3). As a result, the clutch control member 159 pushes the driven clutch 155 away from the driving clutch 153 against the biasing force of the clutch spring 157, so that the clutches are disengaged from each other.

Operation and usage of the hammer drill 101 constructed as described above will now be explained.

As shown in FIG. 2, when the user turns the mode-changing operating member 163 to the hammer drill mode position as shown in FIG. 7, the frame member 173 is caused to move via the second eccentric pin 163*d* toward the tip end (the hammer bit 115) of the hammer drill 101. Thus, the ring 175 and the cam 177 also move in this direction and the cam 177 moves away from the clutch control member 157. As a result, the engagement between the driven clutch 155 and the driving clutch 153 is maintained by the biasing force of the clutch spring 157. Further, by thus turning the mode-changing operating member 163, as shown in FIGS. 7 and 8, the switch actuating member 165 is caused to move toward the tip end of the hammer drill 101 via the first eccentric pin 163*c*. Thus, the end 165*b* of the switch actuating member 165 moves away from the end 123*b* of the trigger 123. As a result, the main switch 125 is held in the OFF position unless the trigger 123 is depressed. At this time, the lug 129*a* of the switch actuating member 129 is located within the locking region 167*a* of the cam groove 167. Therefore, the sub-switch 127 is held in the ON position.

In this state, when the trigger 123 is depressed to turn the main switch 125 to the ON position and the driving motor 111 is driven, the rotation of the driving motor 111 is converted into linear motion via the motion converting mechanism 131. The piston 137 of the motion converting mechanism 131 then reciprocates within the bore of the cylinder 121. The linear motion of the piston 137 is transmitted to the hammer bit 111 via the striker 118 and the impact bolt 119 which form the striking mechanism 117. Further, the rotation of the driving motor 111 is transmitted as rotation to the tool holder 113 and the hammer bit 111 (supported by the tool holder 113 such that the hammer bit 111 is prevented from rotating with respect to the tool holder 113) via the power transmitting mechanism 141. Specifically, the hammer bit 115 is driven with the combined movement of string (hammering) and rotation (drilling). Thus, a predetermined hammer-drill operation can be performed on the workpiece.

When the user turns the mode-changing operating member 163 from the hammer drill mode position as shown in FIG. 7 to the first hammer mode position as shown in FIG. 9, the frame member 173 is caused to move via the second eccentric pin 163*d* toward the rear (the handgrip 109) of the hammer drill 101. Thus, the ring 175 and the cam 177 also move in this direction and the slanted surface 177*a* of the cam 177 presses on the clutch control member 159. As a result, the clutch control member 159 pushes the driven clutch 155 away from the driving clutch 153 against the biasing force of the clutch spring 157, so that the clutches are disengaged from each other. Therefore, the hammer bit 115 does not rotate in the first hammer mode (see FIG. 3).

Further, as shown in FIGS. 9 and 10, by thus turning the mode-changing operating member 163, the switch actuating member 165 is caused to move toward the rear of the hammer drill 101 via the first eccentric pin 163*c*. However, with this travel of the switch actuating member 165, the end 165*b* of the switch actuating member 165 comes near but still stays apart from the end 123*b* of the trigger 123. Therefore, like in the above-mentioned hammer drill mode, the trigger 123 is held in the OFF position and allowed to be depressed to the ON position. Further, the lug 129*a* of the switch actuating member 129 is also located within the locking region 167*a* of the cam groove 167 of the switch actuating member 165. Therefore, the sub-switch 127 is held in the ON position. Specifically, when the mode-changing operating member 163 is turned to the first hammer mode position, the switch actuating member 165 is caused to move so as to allow operation of the trigger 123 and to lock the switch actuating member 129 of the sub-switch 127 in the ON position.

In this state, when the trigger 123 is depressed to turn the main switch 125 to the ON position and the driving motor 111 is driven, the rotation of the driving motor 111 is converted into linear motion via the motion converting mechanism 131. Then, the linear motion is transmitted to the hammer bit 111 via the striker 118 and the impact bolt 119 which form the striking mechanism 117. At this time, the clutch mechanism 151 of the power transmitting mechanism 141 is in the disengaged state, so that rotation is not transmitted to the hammer bit 115. Therefore, in the first hammer mode, the user can perform a predetermined hammering operation solely by the striking movement (hammering) of the hammer bit 115 by depressing the trigger 123 to turn the main switch 125 to the ON position. In the first hammer mode, the hammer bit 115 can be readily driven and stopped by depressing and releasing the trigger 123. Therefore, this mode is particularly useful for a hammering operation in which the hammer bit 115 is driven on an on-again off-again basis.

When the mode-changing operating member 163 is turned from the first hammer mode position shown in FIG. 9 to the second hammer mode position shown in FIG. 11, as shown in FIG. 3, the frame member 173 is caused to move via the second eccentric pin 163*d* farther toward the rear (the handgrip 109) of the hammer drill 101 than in the first hammer mode. Thus, the ring 175 and the cam 177 also move in this direction. At this time, a flat surface of the cam 177 slides on the upper surface of the clutch control member 159, which does not cause to move the clutch control member 159. Therefore, the clutches of the clutch mechanism 151 are held disengaged from each other.

Further, as shown in FIGS. 11 and 12, by thus turning the mode-changing operating member 163, the switch actuating member 165 is caused to move farther toward the rear of the hammer drill 101 via the first eccentric pin 163*c*. By this movement, the end 165*b* of the switch actuating member 165 presses on the end 123*b* of the trigger 123. As a result, the trigger 123 is turned to a depressed position, so that the main switch 125 is turned to and locked in the ON position. Further, the lug 129*a* of the switch actuating member 129 moves from the locking region 167*a* to the switch actuation allowing region 167*b* via the switching region 167*c* in the cam groove 167 as the switch actuating member 165 moves. At this time, in the switching region 167*c*, the V-shaped guide wall 167*d* guides the lug 129*a* of the switch actuating member 129 to move in a direction perpendicular to the moving direction of the switch actuating member 165. As a result, the sub-switch 127 is turned from the ON position to the OFF position (downward as viewed in FIG. 12).

Thus, when the mode-changing operating member 163 is turned to the second hammer mode position, the main switch 125 is locked in the ON position. At the same time, the sub-switch 127 is forced to be turned from the ON position to the OFF position, and then in the switch actuation allowing region 167*b*, the user is allowed to turn the sub-switch 127 on and off.

In this state, when the switch actuating member 129 is pushed to turn the sub-switch 127 from the OFF position to the ON position, the driving motor 111 is driven. The clutch mechanism 151 of the power transmitting mechanism 141 is in the disengaged stat in the second hammer mode, so that the hammer bit 115 only performs a linear motion via the motion converting mechanism 131 and the striking mechanism 117. In the second hammer mode, once the switch actuating member 129 of the sub-switch 127 is pushed in to the ON position, it is held in the ON position unless pushed in the opposite direction. Further, the trigger 123 of the main switch 125 is also locked in the ON position. Therefore, the user can perform a hammering operation by continuously driving the tool bit 115.

Further, in the second hammer mode, when the mode-changing operating member 163 is turned to the first hammer mode position after the switch actuating member 129 of the sub-switch 127 is pushed in to the OFF position, the end 165*b* of the switch actuating member 165 is moved away from the end 123*b* of the trigger 123. As a result, the trigger 123 returns to the ON position together with the main switch 125. Further, by this movement of the switch actuating member 165, the lug 129*a* of the switch actuating member 129 is pressed by the guide wall 167*e* in the switching region 167*c* of the cam groove 167 from the OFF position to the ON position. Thus, like in the above-mentioned case, the user can perform a predetermined hammering operation by the striking movement of the hammer bit 115 by depressing the trigger 123 to turn the main switch 125 to the ON position. According to this embodiment, in the hammering operation in the second hammer mode, the user can drive and stop the hammer bit 115 by sliding the switch actuating member 129 to turn the sub-switch 127 between the ON position and the OFF position as necessary.

On the other hand, according to the prior art, the trigger 123 is locked in the depressed position by an engaging member in order to effect continuous hammering operation. In this case, in order to drive the hammer bit in the hammer mode, the user must depress the trigger 123 and then operate the engaging member to lock the trigger in the depressed position. In other words, the user needs to perform two operations every time when trying to drive the hammer bit. To the contrary, according to this embodiment, the need for any operation of the trigger 123 is eliminated in the second hammer mode. The user only needs to actuate the switch actuating member 129 to toggle the sub-switch on and off. Therefore, ease of operation of the hammer drill 101 is enhanced compared with the prior art.

Further, according to this embodiment, when the mode-changing operating member 163 is turned from the first hammer mode position to the second hammer mode position, the sub-switch 127 is forced to be turned from the ON position to the OFF position. Therefore, even if the user changes from the first hammer mode to the second hammer mode with the trigger 123 inadvertently left depressed, the hammer bit 115 is not driven. Further, in this embodiment, when the mode-changing operating member 163 is turned from the second hammer mode position to the first hammer mode position, the sub-switch 127 is forced to be turned from the OFF position to the ON position. Therefore, the user need not operate the sub-switch 127 when operating the mode-changing operating member 163.

Further, according to this embodiment, the trigger 123 and the switch actuating member 129 are linked with the switch actuating member 165, so that both can be actuated by the switch actuating member 165 as single device. Therefore, the number of parts can be reduced and the structure can be simplified. Further, with the construction in which the actuation of the switch actuating member 129 is controlled by the cam groove 167 of the switch actuating member 165, inadvertent push of the switch actuating member 129 can be reliably prevented in the hammer drill mode or the first hammer mode.

Further, in this embodiment, the switch actuating member 165 moves in the longitudinal direction of the body 103, and the switch actuating member 129 is actuated in a direction perpendicular to the moving direction of the switch actuating member 165 or in a direction of extending through the side surfaces of the body 103. With this construction, the switch actuating member 165 is arranged in a position to keep out of the way of the other functional parts, so that effective arrangement of parts can be realized.

The above-described invention can be applied to an electric hammer in which the hammer bit 155 only performs a striking movement. Further, the lug may be formed on the switch actuating member 165 and the cam groove in the switch actuating member 129.

What is claimed is:

1. A power impact tool, comprising:

a tool body, a motor housed within the tool body, a tool bit being driven by said motor, a first switch and a second switch electrically connected to said motor, both switches are configured to be actuated between an on-position and an off-position with respect to said motor, said motor being driven only when both switches are in the on-position, wherein the first switch is biased to remain in the off-position and the second switch is biased to remain in either the on or off-position unless actuated to the opposite position, and a mode changing mechanism that switches between hammer operation modes of the tool bit, said mode changing being operationally connected to both switches, wherein according to a first hammer mode the first switch is actuated to the on-position to operate the motor while the second switch is locked in the on-position, and according to a second hammer mode the first switch is locked in the on-position while the second switch is actuated between the off and on-position to operate the motor.

2. The power impact tool as defined in claim 1, wherein the mode changing mechanism turns the second electrical switch to the off-position and then allows the user to actuate the second electrical switch when switched from the first hammer mode to the second hammer mode, while the mode changing mechanism turns the second electrical switch from the off-position to the on-position and then locks the second electrical switch in the on-position when switched from the second hammer mode to the first hammer mode.

3. The power impact tool as defined in claim 1, wherein the first electrical switch is defined by a trigger, the trigger being turned to the on-position when depressed by the user, while turned to the off-position when released, and wherein the trigger is held locked in the second hammer mode.

4. The power impact tool as defined in claim 1, wherein:

the first electrical switch includes a trigger, the trigger being turned to the on-position when depressed by the user, while turned to the off-position when released, the second electrical switch includes a second electrical switch actuating member turned to the on-position or to the off position by operation of the user and held in that position unless operated by the user to be turned to the opposite position, the mode changing mechanism includes a mode-changing operating member turned between a first hammer mode position and a second hammer mode position and a first electrical switch actuating member moving in relation to the turning operation of the mode-changing operating member, and the first electrical switch actuating member is linked with the trigger and the second electrical switch actuating member, such that, when the mode-changing operating member is turned to the first hammer mode position, the first electrical switch actuating member allows actuation of the trigger and locks the second electrical switch actuating member in the on-position, while, when the mode-changing operating member is turned to the second hammer mode position, it locks the trigger in the on-position and allows actuation of the second electrical switch actuating member between the on-position and the off-position.

5. The power impact tool as defined in claim 1, wherein the mode changing mechanism includes a mode-changing operating member turned between a first hammer mode position and a second hammer mode position and a switch actuating member linked with the mode-changing operating member such that turning the mode-changing operating member moves the switch actuating member, the switch actuating member moves linearly in relation to the turning of the mode-changing operating member, and the switch actuating member of the second electrical switch is actuated in a direction perpendicular to a moving direction of the switch actuating member.

6. The power impact tool as defined in claim 1, wherein:

the first electrical switch includes a trigger, the trigger being turned to the on-position when depressed by the user, while turned to the off-position when released, the mode changing mechanism includes a mode-changing operating member turned between a first hammer mode position and a second hammer mode position and a switch actuating member linked with the mode-changing operating member such that the turning operation of the mode-changing operating member moves the switch actuating member, the switch actuating member moves in a direction of depressing the trigger, and the trigger is locked in the on-position by the movement of the switch actuating member when the mode-changing operating member is turned to the second hammer mode position, while said locked trigger is released by the movement of the switch actuating member when the mode-changing operating member is turned to the first hammer mode position.

7. The power impact tool as defined in claim 1, wherein:

the second electrical switch includes a second switch actuating member that is defined by a lever protruding from the tool body, the mode changing mechanism includes a mode-changing operating member that is turned between a first hammer mode position and a second hammer mode position and a first switch actuating member that is linked with the mode-changing operating member such that the turning operation of the mode-changing operating member moves the first switch actuating member, the first switch actuating member is defined by an elongated element that moves linearly in relation to the turning of the mode-changing operating member, and the elongated element has a slot extending in the direction of the linear movement, the lever of the second electrical switch being engaged in the slot, and the slot has a cam groove that allows actuation of the lever in a direction that crosses the direction of the linear movement of the switch actuating member.

8. The power impact tool as defined in claim 7, wherein the first electrical switch includes a trigger, the trigger being turned to the on-position when depressed by the user, while turned to the off-position when released, when the mode-changing operating member is turned to the second hammer mode position, the elongated element moves in a direction of linear movement in relation to the turning of the mode-changing member, and an end of the elongated element presses on the trigger, thereby locking the trigger in the on-position.

9. The power impact tool as defined in claim 1, wherein:

the second electrical switch includes a switch actuating member having an elongated actuating part, the actuating part extending laterally through the tool body such that an end region of the actuating part protrudes through a side surface of the tool body slidable in a lateral direction of the tool body between the on-position and off-position.

10. The power impact tool as defined in claim 9, wherein: the end region of the actuating part is arranged such that the user can actuate it together with the first switch by one hand.

11. The power impact tool as defined in claim 1, wherein: the mode changing mechanism is mounted on an upper surface of the tool body and includes a dial that the user can operate on the upper surface of the tool body.

12. The power impact tool as defined in claim 1, wherein: the mode changing mechanism can switch to a drill mode for causing the tool bit to perform rotation and/or a hammer drill mode for causing the tool bit to perform rotation while causing it to perform striking movement, as well as the first and second hammer modes.

13. A portable power tool comprising:

A tool body;

a tool mounting portion at least partially housed in the tool body;

a motor housed in the tool body that drives the tool mounting portion only when a first switch and a second switch are in an on-position, wherein said first and second switches are electrically connected to said motor;

the first switch is biased to remain in an off-position unless held in the on-position by either a user or a mode changing mechanism;

said mode changing mechanism being operationally connected to both switches; the second switch is biased to remain in either the on-position or an off-position unless actuated to the opposite position;

the mode changing mechanism having an intermittent-mode position and a continuous-mode position such that:

in the intermittent-mode position, the second switch is locked in the on-position and the motor is operated by actuating the first switch to the on-position, and in the continuous-mode position, the first switch is locked in the on-position, the second switch is actuated to the off-position, and the motor is operated by actuating the second switch to the on-position.

14. The power tool of claim 13, wherein the portable power tool is a hammer-drill.

15. The power tool of claim 14, wherein the intermittent-mode position corresponds to a hammer-drill mode or a hammer mode and the continuous-mode position corresponds to a hammer mode.

* * * * *